US008581518B2

(12) United States Patent
Kuang et al.

(10) Patent No.: US 8,581,518 B2
(45) Date of Patent: Nov. 12, 2013

(54) TRIAC DIMMER COMPATIBLE SWITCHING MODE POWER SUPPLY AND METHOD THEREOF

(75) Inventors: Naixing Kuang, Hangzhou (CN); Lei Du, Hangzhou (CN); Junming Zhang, Hangzhou (CN); Yuancheng Ren, Hangzhou (CN)

(73) Assignee: Monolithic Power Systems, Inc., San Jose, CA (US)

( * ) Notice: Subject to any disclaimer, the term of this patent is extended or adjusted under 35 U.S.C. 154(b) by 314 days.

(21) Appl. No.: 13/110,719

(22) Filed: May 18, 2011

(65) Prior Publication Data

US 2011/0285301 A1 Nov. 24, 2011

(30) Foreign Application Priority Data

May 19, 2010 (CN) ..... 2010 1 0176247

(51) Int. Cl.
*H05B 37/02* (2006.01)

(52) U.S. Cl.
USPC ..... 315/307; 315/185 R; 315/200 R; 315/209 R; 315/246; 315/291

(58) Field of Classification Search
USPC ..... 315/185 R, 186, 200 R, 201, 209 R, 224, 315/291, 294, 246–247, 287
See application file for complete search history.

(56) References Cited

U.S. PATENT DOCUMENTS

| | | | | |
|---|---|---|---|---|
| 7,888,888 | B2 * | 2/2011 | Huang et al. | 315/307 |
| 8,278,832 | B2 * | 10/2012 | Hung et al. | 315/219 |
| 8,344,657 | B2 * | 1/2013 | Zhan et al. | 315/302 |
| 2002/0033679 | A1 * | 3/2002 | Hui et al. | 315/307 |
| 2005/0017656 | A1 * | 1/2005 | Takahashi et al. | 315/248 |
| 2006/0138973 | A1 * | 6/2006 | Hirosawa | 315/291 |
| 2008/0018261 | A1 * | 1/2008 | Kastner | 315/192 |
| 2009/0261744 | A1 * | 10/2009 | Chen et al. | 315/199 |
| 2010/0164406 | A1 * | 7/2010 | Kost et al. | 315/307 |
| 2010/0165683 | A1 * | 7/2010 | Sugawara | 363/126 |
| 2010/0213857 | A1 * | 8/2010 | Fan | 315/186 |
| 2011/0012530 | A1 * | 1/2011 | Zheng et al. | 315/294 |
| 2011/0025217 | A1 * | 2/2011 | Zhan et al. | 315/219 |
| 2011/0127925 | A1 * | 6/2011 | Huang et al. | 315/287 |

* cited by examiner

*Primary Examiner* — Jason M Crawford
(74) *Attorney, Agent, or Firm* — Perkins Coie LLP

(57) ABSTRACT

Triac dimmer compatible switching mode power supplies used as LED drivers are disclosed herein. A PFC controller is configured in the switching mode power supplies. With the PFC controller, the current keeping the triac in the on-state is supplied by the DC/DC converter, and the LC resonance is reduced.

19 Claims, 9 Drawing Sheets

TRIAC DIMMER COMPATIBLE SWITCHING MODE POWER SUPPLY AND METHOD THEREOF

CROSS-REFERENCE TO RELATED APPLICATION(S)

This application claims priority to Chinese Patent Application No. 201010176247.0, filed on May 19, 2010, the disclosure of which is incorporated herein by reference in its entirety.

TECHNICAL FIELD

The present disclosure relates generally to electrical circuits, and more particularly to switching mode power supplies.

BACKGROUND

A triac, a bidirectional device with a control terminal, is commonly used as a rectifier in power electronics. The triac dimmer circuit is now widely applied in incandescent lamps and halogen lamps. The triac dimmer changes a sine wave shaped voltage such that the output voltage is kept substantially zero as long as the sine wave shaped voltage is below a target level. For example, when the sine wave shaped voltage goes below the target level of zero volts, the triac dimmer circuit does not conduct and blocks the sine wave shaped voltage. After the sine wave shaped voltage has increased to a level above the target level, the triac dimmer circuit conducts, and the output voltage is substantially identical to the input voltage. As soon as the input voltage reaches its next zero crossing, the triac dimmer circuit blocks the input voltage again. Thus, during a first part of each half period of the sine wave, the output voltage is zero. At a target phase angle of the sine wave shaped voltage, the output voltage substantially instantaneously switches to a level corresponding to the sine wave shaped voltage. By controlling the phase angle of the triac dimmer, the triac dimmer achieves light dimming.

To apply a triac dimmer in a switching mode power supply such as a light emitting diode ("LED") driver, a bleeder dummy load is needed to maintain a minimum conducting current in the triac dimmer and to reduce LC resonance. LEDs are generally energy-saving devices, but the dummy load reduces the overall efficiency.

DETAILED DESCRIPTION

The present disclosure provides numerous specific details, such as examples of circuits, components, and methods, to provide a thorough understanding of embodiments of the technology. Persons of ordinary skill in the art will recognize, however, that the technology may be practiced without one or more of the specific details. In other instances, well-known details are not shown or described to avoid obscuring aspects of the technology.

Figure 1:
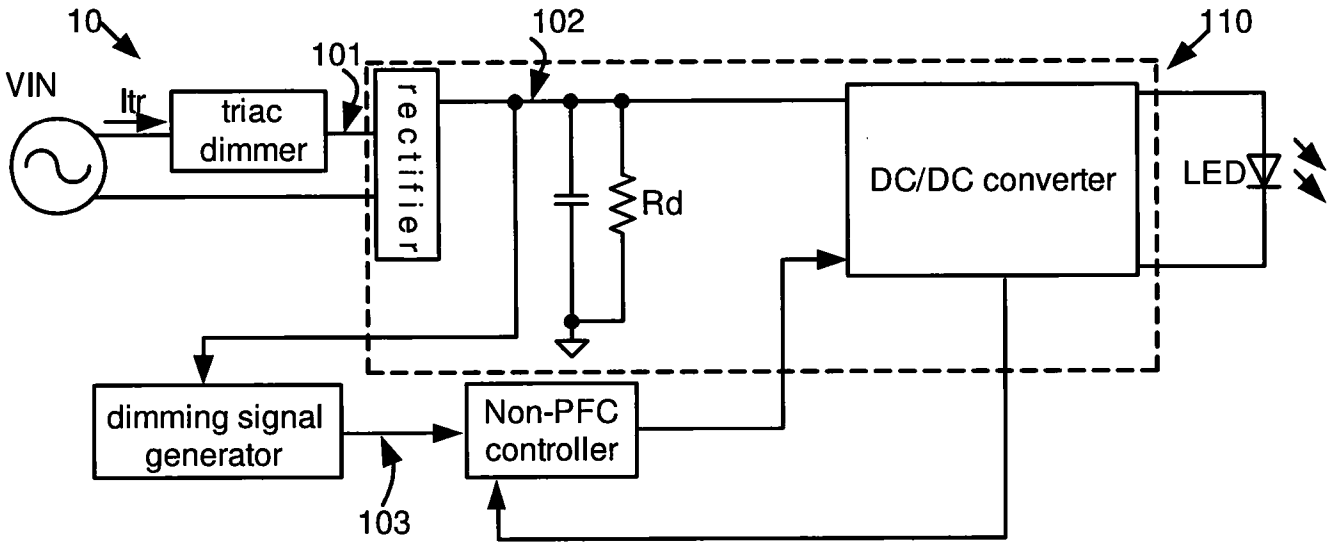
FIG. 1 (Prior Art)
FIG. 1 schematically shows a prior art triac dimmer compatible switching mode power supply 10 used as an LED driver.

FIG. 1 schematically shows a prior art triac dimmer compatible switching mode power supply 10 used as an LED driver. A triac dimmer receives an AC voltage, and outputs a shaped AC voltage with a phase angle determined by a triac dimmer in a path 101. An AC/DC converter 110 is coupled to the shaped voltage supply, and sources current to the LEDs. The AC/DC converter comprises a rectifier, a filter and a DC/DC converter connected as shown.

The load current density which generally corresponds to the luminance of the LEDs is determined by the shaped AC voltage provided to the AC/DC converter. The rectifier rectifies the shaped AC voltage in the path 101 and produces a rectified signal in a path 102. The filter coupled to the rectifier filters the rectified signal. The DC/DC converter receives the filtered rectified signal in path 102, and sources current to the LEDs based thereupon.

A dimming signal generator is coupled to the rectifier to receive the rectified signal from the path 102, and produces a PWM (pulse width modulation) signal in path 103. The pulse width of the PWM signal is varied according to the rectified signal in path 102. A Non-PFC (power factor correction) controller is coupled to the dimming signal generator to receive the PWM signal from path 103, and produces a switching signal. The rectified signal in path 102 is varied in response to the phase angle of the triac dimmer. The pulse width of the PWM signal in path 103 and the switching signal are varied accordingly. Thus the load current density is regulated and the luminance of the LEDs is dimmed.

A dummy load $R_d$ in FIG. 1 is configured to maintain a minimum conducting current in the triac dimmer and to reduce LC resonance. In other words, the dummy load $R_d$ helps to make the conduction of the triac dimmer more controllable. The LEDs have generally low power dissipation, but the dummy load $R_d$ reduces the efficiency of triac dimmer.

Figure 2:
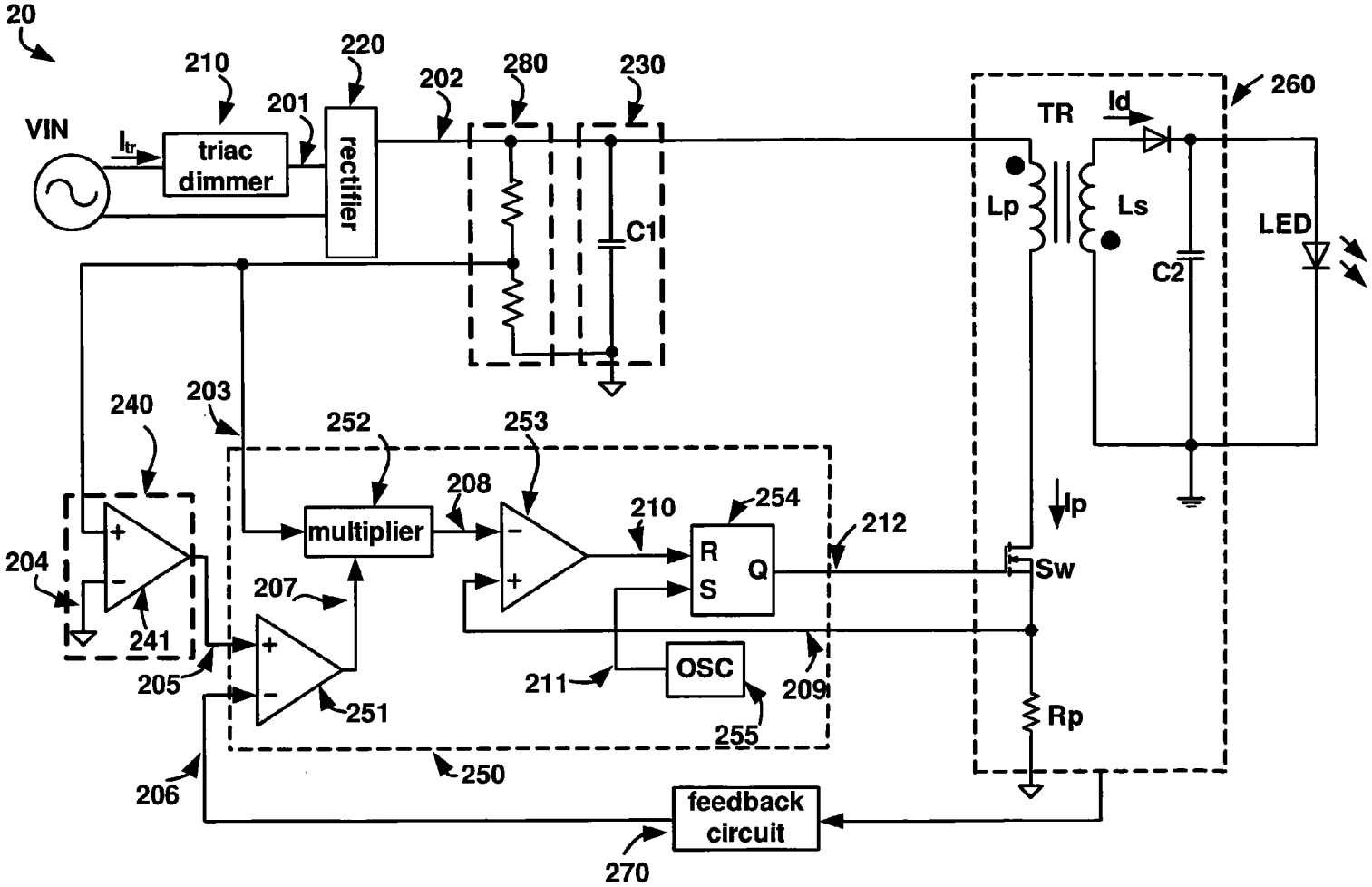
FIG. 2 schematically shows a triac dimmer compatible switching mode power supply 20 with a power factor correction ("PFC") controller used as an LED driver in accordance with an embodiment of the present disclosure.

FIG. 2 schematically shows a triac dimmer compatible switching mode power supply 20 with a PFC controller 250 used as an LED driver in accordance with an embodiment of the present disclosure. In the example of FIG. 2, the switching mode power supply 20 comprises: a triac dimmer 210 that receives an AC input signal VIN, and modifies the AC input voltage VIN with a target phase angle to generate a shaped AC signal to path 201; a rectifier 220 coupled to the triac dimmer 210 to receive the shaped AC signal from path 201, and the rectifier 220 generates a rectified signal to path 202 based on the shaped AC signal; a filter 230 coupled to the rectifier that receives the rectified signal and generates a filtered signal; a DC/DC converter 260 coupled to the filter 230 to receive the filtered signal, and the DC/DC converter 260 is configured to provide power to a load; a dimming signal generator 240 coupled to the rectifier 220 to receive the rectified signal from path 202, and the dimming signal generator 240 generates a dimming signal based on the rectified signal; a feedback circuit 270 coupled to the DC/DC converter 260 to generate a feedback signal indicative of the power supplied to the load by the DC/DC converter; and a PFC controller 250 having a first input terminal 205, a second input terminal 203, a third input terminal 209, a fourth input terminal 206, and an output terminal 212, and the first input terminal 205 is coupled to the dimming signal generator 230 to receive the dimming signal, the second input terminal 203 is coupled to the rectifier 220 to receive the rectified signal, the third input terminal 209 is coupled to the DC/DC converter 260 to receive a sense signal indicative of a current flowing through the DC/DC converter, the fourth input terminal 206 is coupled to the feedback circuit 270 to receive the feedback signal, and wherein based on the dimming signal, the rectified signal, the sense signal, and the feedback signal, the PFC controller 250 provides a switching signal at the output terminal 212 to the DC/DC converter.

Compared to the prior art device of FIG. 1, the embodiment shown in FIG. 2 eliminates the dummy load $R_d$ and adopts the PFC controller 250 instead of the Non-PFC controller. In the illustrated embodiment, the current that keeps the triac dimmer in an on-state is supplied by the DC/DC converter itself, and the LC resonance is at least reduced, such that the dummy load is eliminated.

In the example of FIG. 2, the switching mode power supply 20 further comprises a voltage divider 280 coupled to the rectifier 220 to receive the rectified signal, and the voltage divider 280 provides a divided signal with suitable level to the dimming signal generator 240 and to the fourth input terminal of the PFC controller 250. However, the voltage divider may be eliminated in other embodiments. Compared to the rectified signal in path 202, the divided signal has the same shape, but at an attenuated level.

In FIG. 2, the dimming signal generator 240 comprises: a first comparator 241 having a first input terminal, a second input terminal, and an output terminal, and the first input terminal is coupled to the rectifier 220 to receive the rectified signal, the second input terminal is coupled to a reference signal 204, and based on the rectified signal and the reference signal, the first comparator 241 provides the dimming signal at the output terminal. In one embodiment, the second input terminal is connected to the ground. When the divided signal is higher than zero, i.e., the rectified signal is higher than zero, the first comparator 241 generates a logical high signal. When the divided signal is lower than or equal to zero, i.e., the rectified signal is lower than or equal to zero, the first comparator 241 generates a logical low signal. The width of the logical low and the logical high may be regulated by changing the phase angle of the triac dimmer 210, so the dimming signal in this embodiment is a PWM signal. The dimming signal may be an amplitude variable signal in other embodiments. Any suitable signal generator that generates an amplitude variable signal or a frequency variable signal based on the input signal may be used.

In the example of FIG. 2, the PFC controller 250 comprises an oscillator 255 configured to provide a set signal to path 211; an error amplifier 251 having a first input terminal (205), a second input terminal (206), and an output terminal, wherein the first input terminal is coupled to the dimming signal generator 240 to receive the dimming signal, the second input terminal is coupled to the feedback circuit 270 to receive the feedback signal, and wherein based on the dimming signal and the feedback signal, the error amplifier 251 provides an error amplified signal to path 207; a multiplier 252 having a first input terminal (203), a second input terminal, and an output terminal, wherein the first input terminal is coupled to the rectifier to receive the rectified signal, the second input terminal is coupled to the output terminal of the error amplifier 251 to receive the error amplified signal from path 207, and based on the rectified signal and the error amplified signal, the multiplier 252 provides an arithmetical signal at the output terminal; a second comparator 253 having a first input terminal, a second input terminal (209), and an output terminal, wherein the first input terminal is coupled to the output terminal of the multiplier 252 to receive the arithmetical signal, the second input terminal is coupled to the DC/DC converter 260 to receive the sense signal, and based on the arithmetical signal and the sense signal, the second comparator 253 provides a reset signal to path 210; and a logic circuit 254 having a first input terminal, a second input terminal, and an output terminal, the first input terminal is coupled to the second comparator 252 to receive the reset signal from path 210, the second input terminal is coupled to the oscillator 255 to receive the set signal from path 211, and based on the reset signal and the set signal, the logic circuit 254 provides the switching signal to path 212 to control the main switch in the DC/DC converter 260.

In the example of FIG. 2, the DC/DC converter 260 comprises a flyback converter having: a transformer TR with a primary winding $L_p$ and a secondary winding $L_s$ as an energy storage component; a main switch $S_w$ coupled between the primary winding $L_p$ of the transformer TR and a resistor $R_p$, the resistor is coupled between the main switch and ground; and a diode coupled between the secondary winding and a capacitor C2, the capacitor C2 is coupled between the diode and ground. The power to the load is provided by the secondary winding $L_s$. However, in other embodiments, the DC/DC converter may comprise any other suitable types of converters, for example, buck, boost, buck-boost, spec, push-pull, half-bridge or forward converter. In buck converters, boost converters, buck-boost converters and spec converters, the energy storage component comprises an inductance. In push-pull converters, half-bridge converters and forward converters, the energy storage component comprises a transformer.

Figure 5:
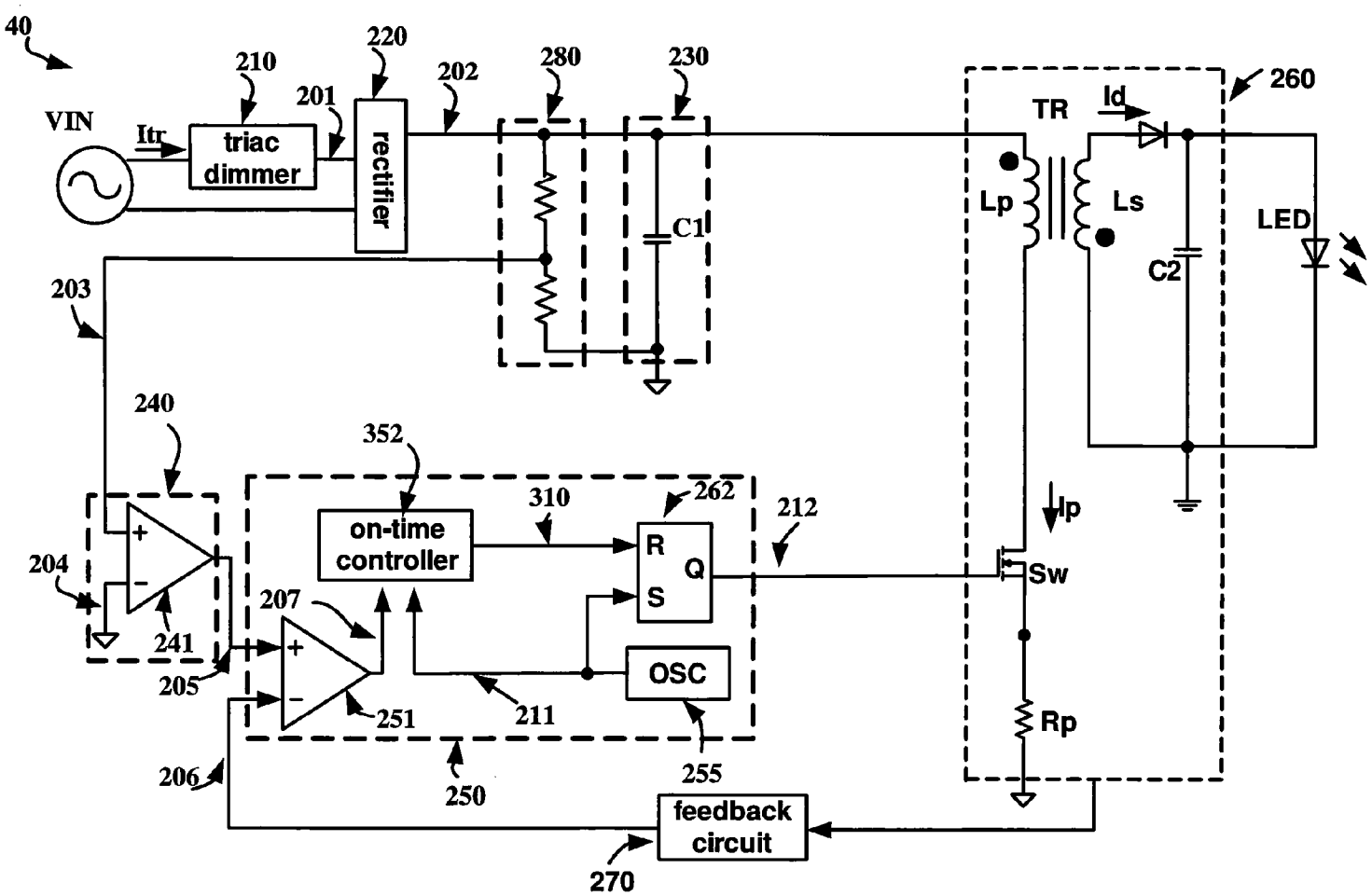
FIG. 5 schematically shows a triac dimmer compatible switching mode power supply 40 with a PFC controller used as an LED driver in accordance with an embodiment of the present disclosure.
Figure 7:
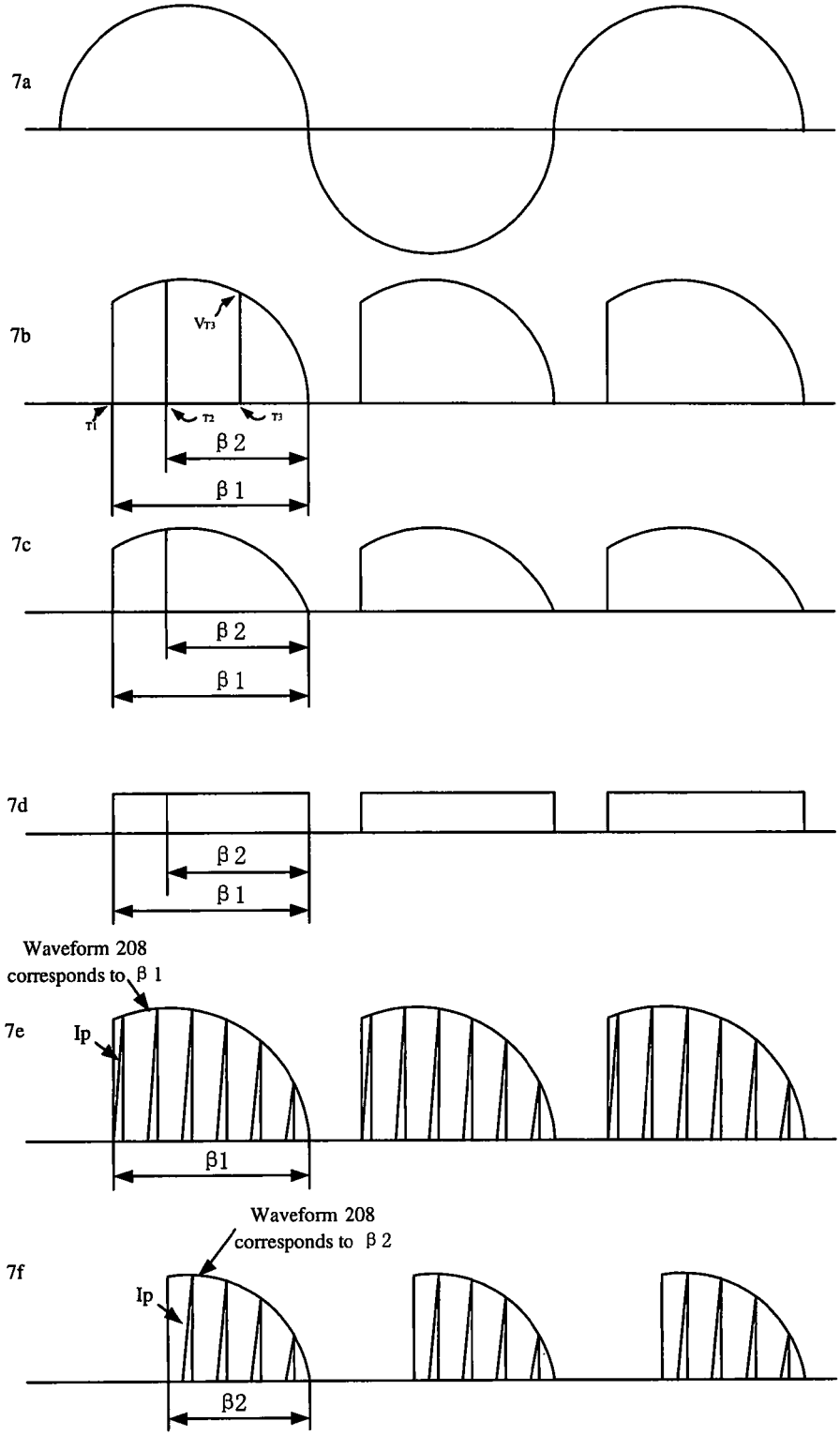
FIG. 7 shows an example timing diagram of signals in the switching mode power supply of FIG. 2 and FIG. 5.

FIG. 7 shows an example of a timing diagram of signals in the switching mode power supply of FIGS. 2 and 5. The waveforms in FIG. 7 show one and a half switching cycles. The operation of the triac dimmer compatible switching mode power supply with a PFC controller used as an LED driver is now explained with reference to FIGS. 2 and 7.

Waveform 7*a* represents the AC input signal VIN. The triac dimmer receives the AC input signal and produces the shaped AC signal in path 201 with a target phase angle. The rectifier rectifies the shaped AC signal and generates the rectified signal in path 202. The filter 220 filters the rectified signal in path 202. The DC/DC converter 260 receives the filtered signal and sources a varying current to the load.

Waveform 7*b* represents the rectified signal in path 202, β1 and β2 represent different phase angles of the triac dimmer. If the triac dimmer circuit conducts at time T1, the shaped AC signal has a phase angle β1; and if the triac dimmer circuit conducts at time T2, the shaped AC signal has a phase angle β2. So different phase angle results in different shaped AC signal. Waveform 7*c* represents the divided signal provided by the voltage divider 280. Compared to the rectified signal in path 202, the divided signal have the same shape, but with an attenuated level.

Waveform 7*d* represents the dimming signal provided by the dimming signal generator 240. As shown in FIG. 7, the dimming signal is logical high when the divided signal is higher than zero; and the dimming signal is logical low when the divided signal is lower than or equal to zero. As previously discussed, the divided signal is proportional to the rectified signal in path 202, and the rectified signal is generated based on the shaped AC signal, so the dimming signal has a pulse width varied according to the shaped AC signal.

A feedback signal is provided by the feedback circuit 270 to regulate the DC/DC converter according to load conditions. The dimming signal is compared with the feedback signal, and the difference between the dimming signal and the feedback signal is amplified by the error amplifier 251 to get the error amplified signal. Then the error amplified signal is multiplied with the divided signal by the multiplier 252 to get the arithmetical signal. The shape of the arithmetical signal in path 208 is similar to that of the divided signal, and the amplitude of the arithmetical signal may be regulated by the error amplified signal from path 207.

The second comparator 253 receives the arithmetical signal from path 208 and the sense signal indicative of the current flowing through the main switch $S_w$, and based on the arithmetical signal and the sense signal, the comparator generates a reset signal to the logic circuit 254.

In the example of FIG. 2, the logic circuit 254 comprises a RS flip-flop having a set input terminal S, a reset input terminal R, and an output terminal Q, the set signal is coupled to the set input terminal S of the RS flip-flop to turn on the main switch $S_w$ of the flyback converter, the reset signal is coupled to the reset input terminal R of the RS flip-flop to turn off the main switch $S_w$ of the flyback converter. When the main switch $S_w$ is turned on, the current $I_p$ flowing through the primary winding $L_p$ increases, so does the current flowing through the main switch $S_w$. When the current flowing through the main switch $S_w$ increases to be higher than the arithmetical signal in path 208, the second comparator 253 generates a high level reset signal to reset the RS flip-flop. Accordingly, the main switch $S_w$ is turned off. Then the energy stored in the primary winding $L_p$ is transferred to the secondary winding $L_s$ of the transformer TR, and the current flowing through the primary winding $L_p$ begins to decrease. The flyback converter is usually designed to work in the current discontinuous mode, such that the current $I_p$ in the primary winding $L_p$ decreases to zero before the next switching cycle begins. After a switching cycle time, the main switch $S_w$ is turned on by the set signal generated by the oscillator, the current in the primary winding $L_p$ increases again, and the process repeats.

Waveform 7*e* shows the arithmetical signal provided by the multiplier 252 and the sense signal, where the triac dimmer 210 has a phase angle β1. As is seen from waveform 7*e*, the shapes of the arithmetical signal, the divided signal and the shaped AC signal are similar. The sense signal increases when the main switch $S_w$ is turned ON. Once the sense signal reaches the arithmetical signal, the second comparator 253 generates a logical high signal to reset the RS flip-flop, and the main switch $S_w$ is turned OFF accordingly. So the peak value of the sense signal has an envelope shape similar to the shape of the arithmetical signal. That means the peak value $I_{pk}$ of the current $I_p$ flowing through the primary winding has an envelope shape similar to the shape of the shaped AC voltage. Waveform 7*f* shows the arithmetical signal and the sense signal, where the triac dimmer 210 has a phase angle β2.

In the example of FIG. 2, the filter 230 comprises a first capacitor C1. The shape of an input current $I_{tr}$ is similar to that of the envelope of the peak current $I_{pk}$ because of the filter 230. So the input current $I_{tr}$ has the same shape with the shaped AC signal in path 201. Thus the triac dimmer 210 is controllable without the dummy load, and the efficiency of the LED driver 20 can be improved.

The phase angle of the triac dimmer may be controlled. As is seen from FIG. 7, the larger the phase angle, the more energy is transferred to the load. So the current density of the LEDs is controlled by changing the phase angle of the triac dimmer. In one embodiment, the feedback circuit 270 can comprise an average load current calculator 370 (shown in FIG. 3) having a first input terminal 212, a second input terminal 213, and an output terminal (206), the first input terminal 212 is coupled to the logic circuit 254 to receive the switching signal, the second input terminal 213 is coupled to the primary winding $L_p$ to receive the sense signal, and based on the switching signal and the sense signal, the average load current calculator provides the feedback signal to path 206.

Figure 3:
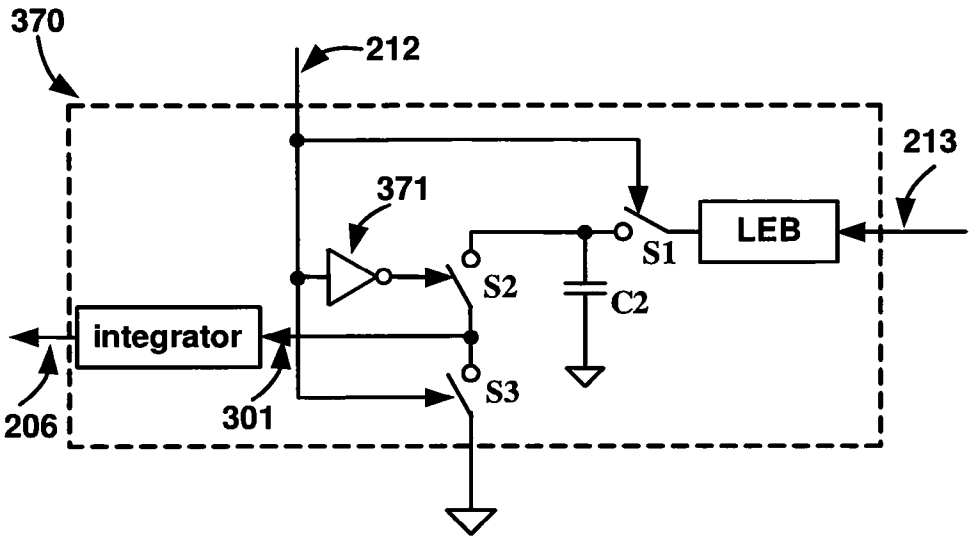
FIG. 3 schematically shows an average load current calculator in accordance with an embodiment of the present disclosure.

FIG. 3 schematically shows an average load current calculator 370 in accordance with an embodiment of the present disclosure. The average load current calculator 370 comprises an inverter 371 configured to receive the switching signal, and based on the switching signal, the inverter 371 generates an inverse signal of the switching signal; a first switch S1 having a first terminal and a second terminal, the first terminal receives the sense signal; a second capacitor C2 coupled between the second terminal of the first switch and ground; a second switch S2 having a first terminal and a second terminal, the first terminal of the second switch is coupled to the second terminal of the first switch, and a square-wave signal is provided at the second terminal; a third switch S3 coupled between the second terminal of the second switch and ground; and an integrator having an input terminal and an output terminal, the input terminal is coupled to the second terminal of the second switch S2 to receive the square-wave signal, and based on the square-wave signal, the integrator generates the feedback signal indicative of an average load current at the output terminal; the first switch S1 and the third switch S3 are controlled by the switching signal; the second switch S2 is controlled by the inverse signal of the switching signal, and the feedback signal is provided at the output terminal of the integrator.

In a switching cycle, when the switching signal is high, i.e., the main switch $S_w$ is turned on, the first switch S1 and the third switch S3 are turned on, and the second switch S2 is turned off. Then the second capacitor C2 is charged by the sense signal, and the signal in path 301 is zero. When the current flowing through the main switch $S_w$ reaches a peak value $I_{pk}$, the voltage across the second capacitor $C_2$ reaches the maximum value $I_{pk} \times R_p$. Then the switching signal goes low. Accordingly, the main switch $S_w$, the first switch S1 and the third switch S3 are turned off, and the second switch S2 is turned on. Then the second capacitor C2 is coupled to the input terminal of the integrator. The integrator receives the square-wave signal and generates the feedback signal. Assume the on time of the main switch $S_w$ is $T_{on}$, the off-time of the main switch $S_w$ is $T_{off}$, and the turns ratio of the transformer is N, the average value $I_{eq}$ of the square-wave signal in path 301 and the average value $I_o$ of the load current is expressed as:

$$I_{eq} = \frac{I_{PK} \times R_p \times T_{off}}{T_{on} + T_{off}} \quad (1)$$

$$I_o = \overline{I_d} = \frac{I_{PK} \times N \times T_{off}}{2 \times (T_{on} + T_{off})} \quad (2)$$

where $\overline{I_d}$ represents the average value of the current $I_d$ in the secondary winding $L_s$, substitute Eq. (2) into Eq. (1) and the solution for the peak current $I_{pk}$ yields:

$$I_{eq} = \frac{2R_P \times I_o}{N} \quad (3)$$

It can be seen from Eq. (3) that the average of square-wave signal $I_{eq}$ is proportional to the average load current. That is, the average of square-wave signal is indicative of the average load current. The integrator receives the square-wave signal in path 301 and generates the average signal $I_{eq}$ as the feedback signal.

If the LEDs become brighter suddenly, i.e., the load current increases suddenly, the feedback signal provided by the feedback circuit 270 increases, and the error amplified signal provided by the error amplifier 251 decreases. The arithmetical signal provided by the multiplier 252 decreases accordingly. Thus the peak value of the current flowing through the switch decreases, and the energy transferred to the LEDs decreases accordingly. As a result, the load current decreases, and the luminance of the LEDs is dimmed or reduced.

Figure 4:
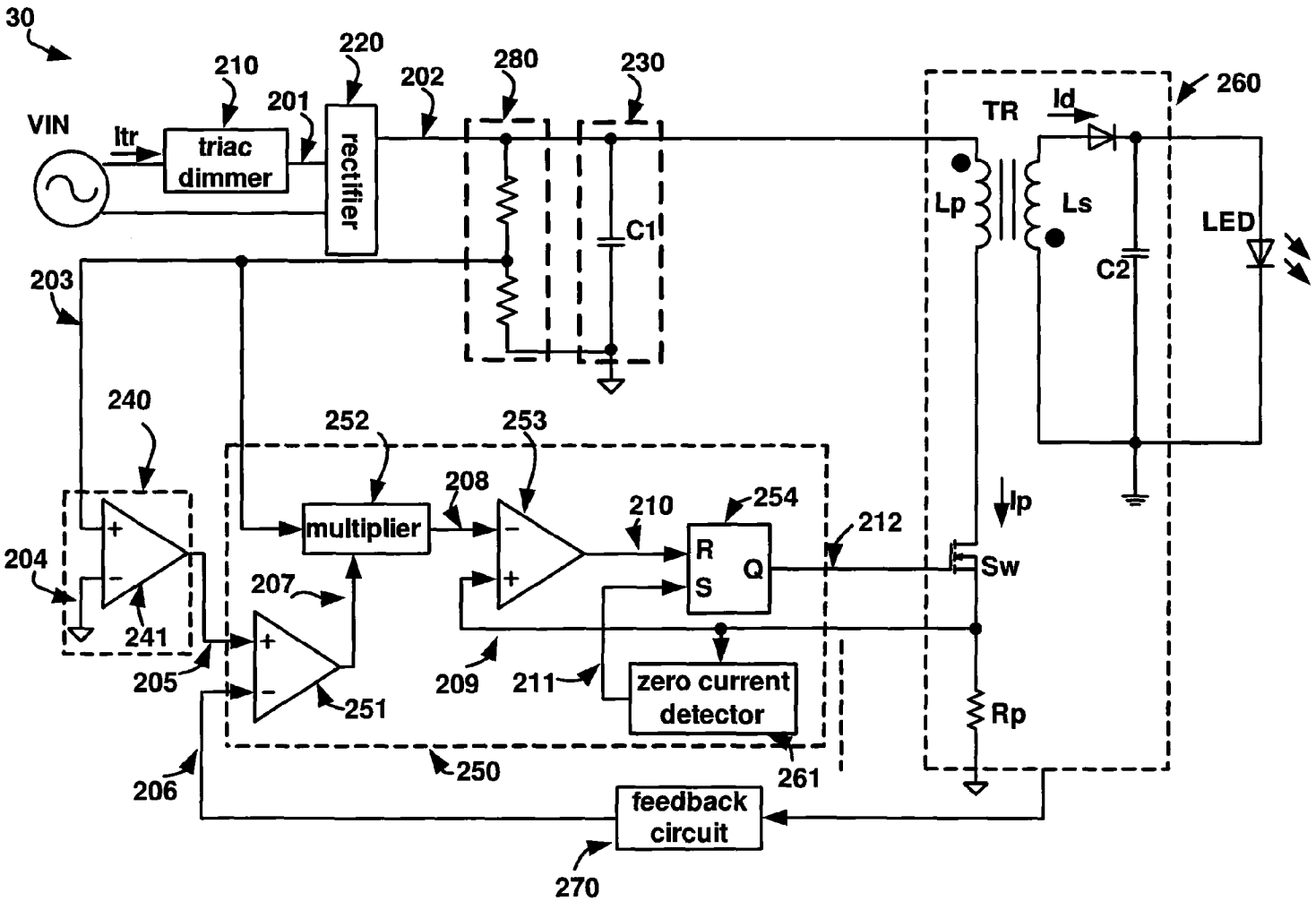
FIG. 4 schematically shows a triac dimmer compatible switching mode power supply 30 with a PFC controller used as an LED driver in accordance with an embodiment of the present disclosure.

FIG. 4 schematically shows a triac dimmer compatible switching mode power supply with a PFC controller used as an LED driver in accordance with an embodiment of the present disclosure. In the example of FIG. 4, the oscillator 255 in FIG. 2 is replaced with a zero current detector 261. The flyback converter works under critical conduction mode. The zero current detector 261 detects a current flowing through the energy storage component, and generates the set signal based on the detection. In the embodiment where a flyback is adopted as the energy storage component, the zero current detector detects a current flowing through the secondary winding of the transformer to generate a zero current signal as the set signal. In other embodiments where an inductor is adopted as the energy storage component, the zero current detector detects a current flowing through the inductor to generate a zero current signal as the set signal.

In one embodiment, the flyback converter further comprises a third winding coupled to the zero current detector 261 (not shown). When the current flowing through the secondary winding $L_p$ of the flyback converter crosses zero, an oscillation is generated due to parasitic capacitor of the main switch $S_w$ and magnetizing inductor of the primary winding. When the oscillation first crosses zero, a voltage across the third winding also crosses zero. Accordingly, the zero current detector 261 generates a high level set signal in response to the zero crossing of the voltage across the third winding. The RS flip-flop is set and the main switch $S_w$ is turned on. Then the current $I_p$ flowing through the primary winding and the main switch $S_w$ increases. When the current flowing through the switch $S_w$ increases to be higher than the arithmetical signal, the second comparator 253 generates a logical high reset signal to reset the RS flip-flop. Accordingly, the switch $S_w$ is turned off. Then the energy stored in the primary winding is transferred to the secondary winding, and the current flowing through the secondary winding starts to decrease. When it decreases to zero, the process repeats.

In one embodiment, instead of adopting the third winding, the flyback converter may adopt a capacitor coupled between the primary winding and the zero current detector 261 to sense the zero crossing of the current flowing through the secondary winding (not shown). The operation of the zero current detector 261 is similar whether the third winding is adopted or a capacitor is adopted. In other embodiments, the zero current detector may detect the current flowing through the secondary winding of the transformer with other techniques. The operation of the switching mode power supply 30 in FIG. 4 is similar with the operation of the switching mode power supply 20 in FIG. 2.

FIG. 5 schematically shows a triac dimmer compatible switching mode power supply 40 with a PFC controller used as an LED driver in accordance with an embodiment of the present disclosure. Compared to the embodiment in FIG. 2, the embodiment in FIG. 5 adopts an on-time controller 352 instead of the multiplier 252 and the comparator 253 in the PFC controller 250.

The PFC controller 250 in FIG. 5 comprises: an oscillator 255 configured to provide a set signal; an error amplifier 251 having a first input terminal (205), a second input terminal (206), and an output terminal, the first input terminal (205) is coupled to the dimming signal generator 240 to receive the dimming signal, the second input terminal (206) is coupled to the feedback circuit 270 to receive the feedback signal, and based on the dimming signal and the feedback signal, the error amplifier 251 provides an error amplified signal to path 207; an on-time controller 352 having a first input terminal, a second input terminal, and an output terminal, the first input terminal is coupled to the oscillator 255 to receive the set signal from path 211, the second input terminal is coupled to the error amplifier 251 to receive the error amplified signal from path 207, and based on the set signal and the error amplified signal, the on-time controller 352 provides a reset signal at the output terminal; and a logic circuit 262 having a first input terminal, a second input terminal, and an output terminal, the first input terminal is coupled to the on-time controller 352 to receive the reset signal from path 310, the second input terminal is coupled to the oscillator to receive the set signal from path 211, and based on the reset signal and the set signal, the logic circuit 262 provides a switching signal to path 212 to control the main switch in the DC/DC converter.

In the example of FIG. 5, if the AC input signal VIN, the phase angle of the triac dimmer, and the feedback signal are all fixed, the amplified error signal provided by the error amplifier 251 is fixed, too. In one embodiment, the logic circuit 262 comprises a RS flip-flop. At the beginning of a cycle, the oscillator 255 generates a set signal to set the RS flip-flop, and the main switch in the DC/DC converter 260 is turned on. Then the current $I_p$ in the primary winding $L_p$ of the transformer TR increases. After a time period determined by the reset signal provided by the on-time controller 352, the main switch $S_w$ is turned off, and the energy stored in the primary winding is transferred to the load. Accordingly, the current $I_p$ in the primary winding $L_p$ starts to decrease until another switching cycle begins. The oscillator 255 again provides a set signal to set the RS flip-flop, and the process repeats.

In one embodiment, the on-time controller 352 comprises a timer, the amplified error signal provided by the error amplifier 251 determines the on time of the reset signal, and the set signal provided by the oscillator 255 controls the cycle time of the reset signal. The operation of the on-time controller 352 is explained with reference to waveform 7*b* in FIG. 7. If the switching mode power supply in FIG. 5 is powered by a utility power, the AC input signal VIN has a low frequency which is usually 50 Hz, thus both the rectified signal and the divided signal have a frequency of 100 Hz. While the main switch $S_w$ works at high frequency which is usually tens of KHz or several MHz. The frequency of the main switch $S_w$ is much higher than the frequencies the rectified signal the divided signal. Assume the main switch $S_w$ is turned on at time point $T_3$, then the peak current $I_{pk}$ of the current $I_p$ is:

$$I_{pk} = \frac{V_{T3} \times T_{ON}}{L} \tag{4}$$

where $V_{T3}$ is the voltage value of the rectified signal at time point $T_3$, and $T_{ON}$ is the corresponding on time of the reset signal. In a steady state, the AC input signal, the phase angle of the triac dimmer and the feedback signal are fixed, thus the amplified error signal and the on time $T_{ON}$ are fixed, too. As be seen from Eq. (4), the peak value $I_{pk}$ of the current flowing through the main switch $I_p$ is proportional to the signal $V_{T3}$. So the envelope of peak value $I_{pk}$ of the current $I_p$ has the same shape with the voltage in path 201. After being filtered by the capacitor C1, the shape of the input current $I_{tr}$ is similar to the shape of the voltage in path 201.

In the example of FIG. 5, the on time of the reset signal provided by the on-time controller 352 determines the current density of the load, where the on time of the reset signal is controlled by the phase angle of the triac dimmer. If the phase angle of the triac dimmer changes, the duty cycle of the dimming signal changes; if the feedback signal 206 is fixed, then the amplified error signal in path 207 changes according to the dimming signal in path 205, and the on time of the reset signal changes correspondingly. The on time of the reset signal is same with the on time of the main switch $S_w$, and the peak value $I_{pk}$ of the current $I_p$ is proportional to the on time of the switch $S_w$, so is the energy transferred to the load. Thus, the current density of the LEDs is controlled by changing the phase angle of the triac dimmer.

In the example of FIG. 5, if the LEDs become brighter suddenly, i.e., the load current increases suddenly, the feedback signal increases, and the amplified error signal decreases. Accordingly, the on time of the reset signal decreases correspondingly, so does the on time of the main switch $S_w$. Thus the energy transferred to the load reduces correspondingly, the load current decreases, and the luminance of the LEDs is dimmed.

Figure 6:
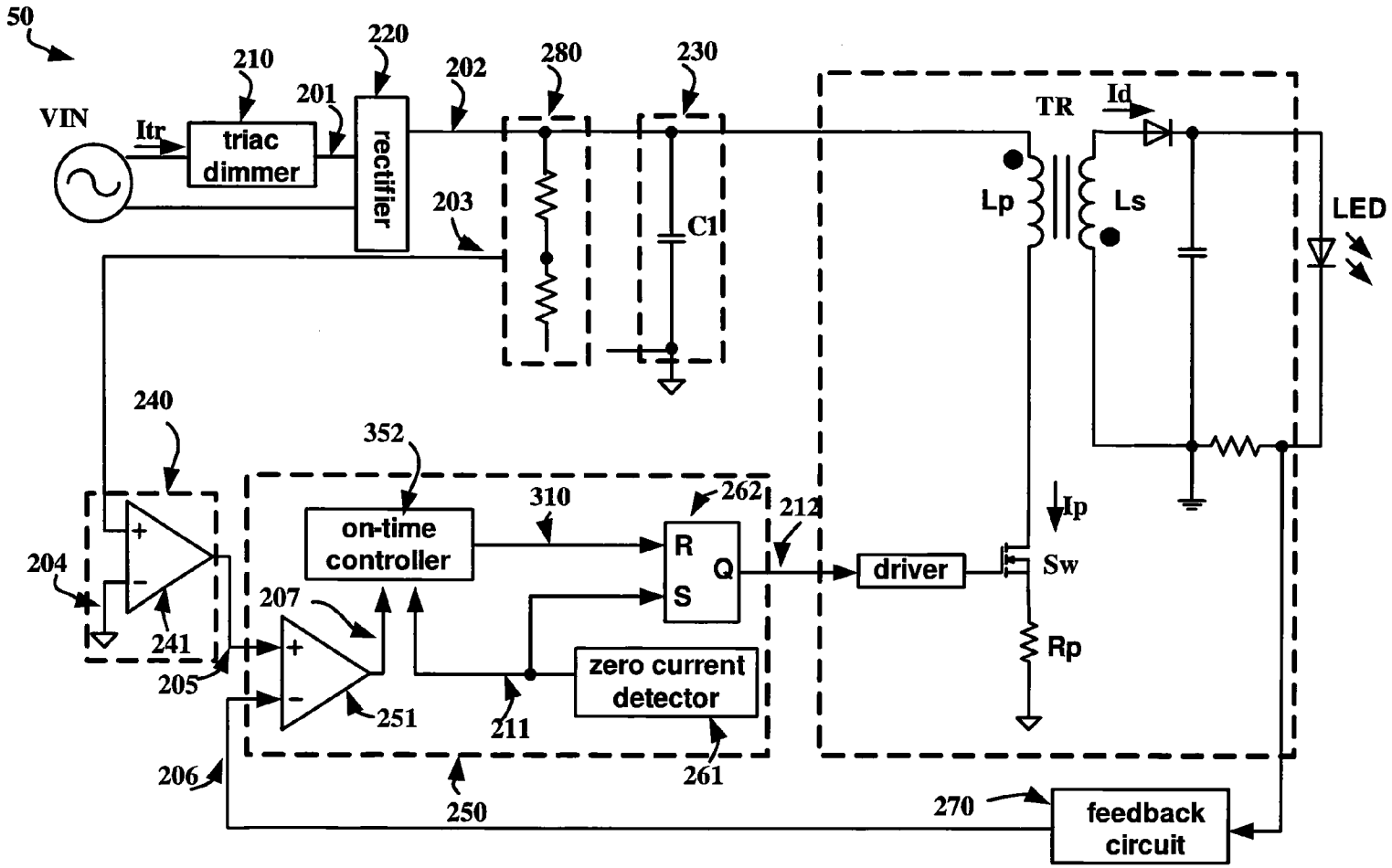
FIG. 6 schematically shows a triac dimmer compatible switching mode power supply 50 with a PFC controller used as an LED driver in accordance with an embodiment of the present disclosure.

FIG. 6 schematically shows a triac dimmer compatible switching mode power supply 50 with a PFC controller used as an LED driver in accordance with an embodiment of the present disclosure. In the example of FIG. 6, the oscillator 255 is replaced by a zero current detector 261. The zero current detector 261 detects the current flowing through the secondary winding $L_s$ of the flyback converter.

Figure 8:
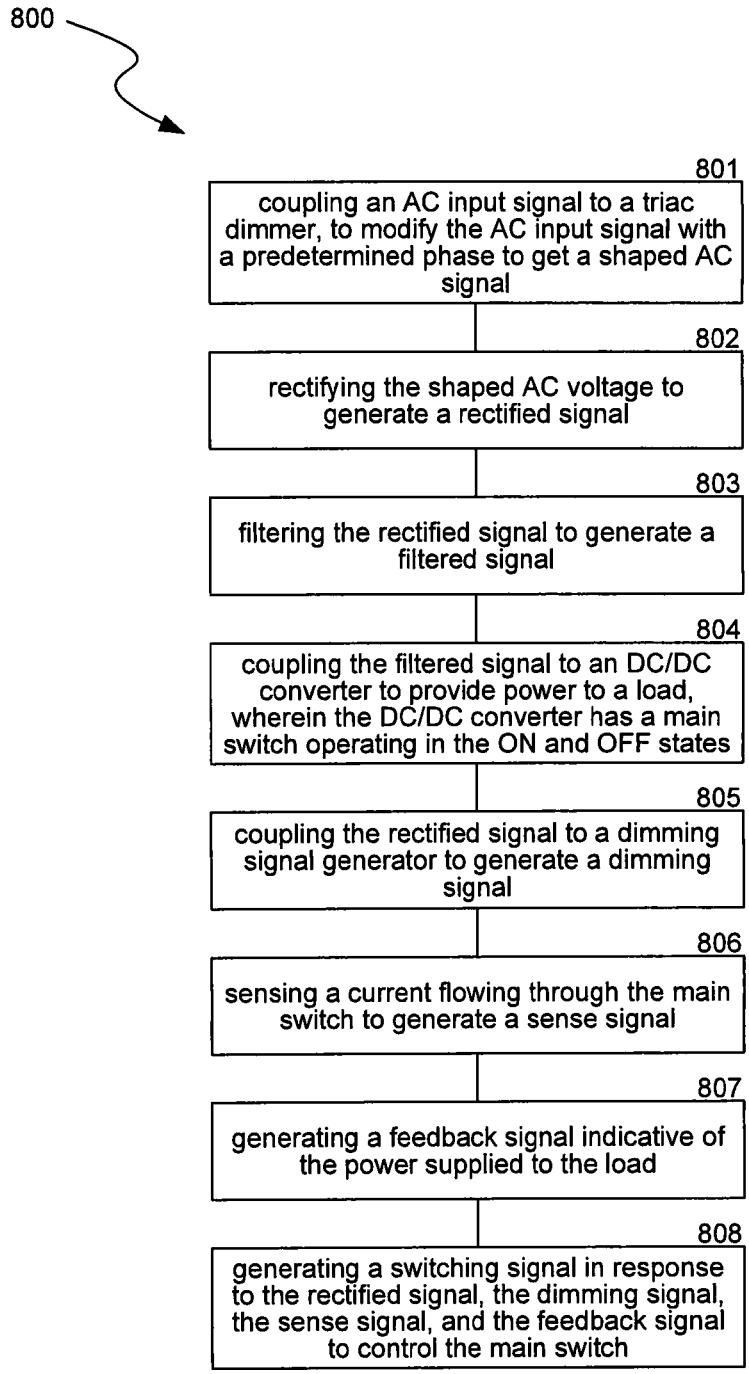
FIG. 8 shows a flow diagram of a method 800 of controlling a switching mode power supply in accordance with an embodiment of the present disclosure.

Referring now to FIG. 8, there is shown a flow diagram of a method 800 of controlling a switching mode power supply in accordance with an embodiment of the present disclosure, comprising: coupling an AC input signal to a triac dimmer, to modify the AC input signal with a target phase to get a shaped AC signal; rectifying the shaped AC signal to generate a rectified signal; filtering the rectified signal to generate a filtered signal; coupling the filtered signal to a DC/DC converter to provide an output signal to a load, the DC/DC converter has a main switch operating in the ON and OFF states; coupling the rectified signal to a dimming signal generator to generate a dimming signal; sensing a current flowing through the main switch to generate a sense signal; generating a feedback signal indicative of the power supplied to the load; and generating a switching signal in response to the rectified signal, the dimming signal, the sense signal, and the feedback signal to control the main switch. The method 800 may be performed using components shown in FIGS. 2-6 and/or other suitable components.

In stage 808, generating a switching signal comprises: amplifying the difference between the dimming signal and the feedback signal to generate an error amplified signal; multiplying the error amplified signal with the rectified signal to generate an arithmetical signal; and comparing the arithmetical signal with the sense signal to generate a reset signal; generating an oscillation signal as a set signal; and generating the switching signal based on the reset signal and the set signal.

The stage 808 may also comprise: amplifying the difference between the dimming signal and the feedback signal to generate an error amplified signal; multiplying the error amplified signal with the rectified signal to generate an arithmetical signal; comparing the arithmetical signal with the sense signal to generate a reset signal; detecting a current flowing through the energy storage component to generate a zero current signal as a set signal; and generating the switching signal based on the reset signal and the set signal.

Figure 9:
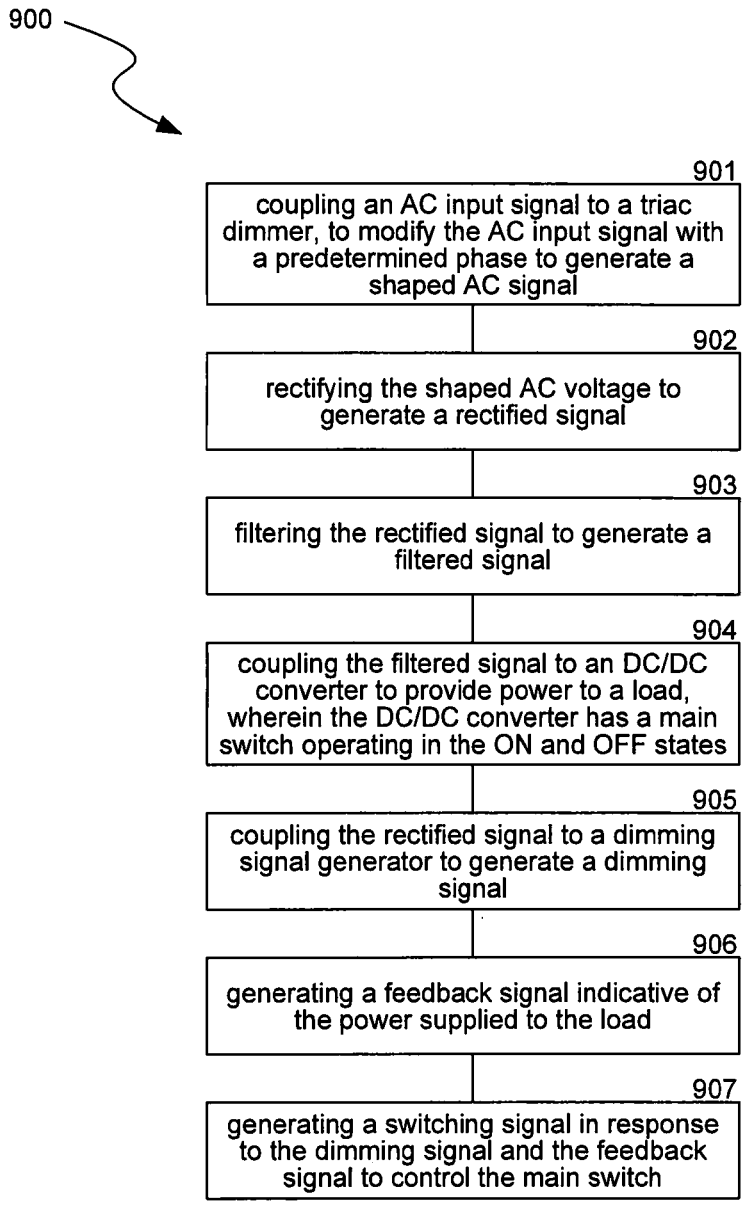
FIG. 9 shows a flow diagram of a method 900 of controlling a switching mode power supply in accordance with an embodiment of the present disclosure.

Referring now to FIG. 9, there is shown a flow diagram of a method 900 of controlling a switching mode power supply in accordance with an embodiment of the present disclosures, comprising: coupling an AC input signal to a triac dimmer, to modify the AC input signal with a target phase to generate a shaped AC signal; rectifying the shaped AC signal to generate a rectified signal; filtering the rectified signal to generate a filtered signal; coupling the filtered signal to a DC/DC converter to provide power to a load, the DC/DC converter has a main switch operating in the ON and OFF states; coupling the rectified signal to a dimming signal generator to generate a dimming signal; generating a feedback signal indicative of the power supplied to the load; and generating a switching signal used to control the main switch to operate between ON and OFF states in response to the dimming signal and the feedback signal.

In one embodiment, generating a switching signal can comprise: generating an oscillation signal by an oscillator as a set signal; amplifying the difference between the dimming signal and the feedback signal to generate an error amplified signal; generating a reset signal in response to the error amplified signal and the set signal by an on-time controller; and generating a switching signal in response to the set signal and the reset signal.

In another embodiment, the stage 907 may comprise: detecting a current flowing through the energy storage component to generate a zero current signal as a set signal; amplifying the difference between the dimming signal and the feedback signal to generate an error amplified signal; generating a reset signal in response to the error amplified signal and the set signal by an on-time controller; and generating a switching signal in response to the set signal and the reset signal.

From the foregoing, it will be appreciated that specific embodiments of the technology have been described herein for purposes of illustration, but that various modifications may be made without deviating from the disclosure. In addition, many of the elements of one embodiment may be combined with other embodiments in addition to or in lieu of the elements of the other embodiments. Accordingly, the disclosure is not limited except as by the appended claims.

We claim:

1. A switching mode power supply, comprising:

a triac dimmer, wherein the triac dimmer configured to receive an AC input signal and to modify the AC input signal with a target phase angle to generate a shaped AC signal;

a rectifier coupled to the triac dimmer to receive the shaped AC signal, the rectifier being configured to generate a rectified signal based on the shaped AC signal;

a filter coupled to the rectifier, the filter being configured to receive the rectified signal and generate a filtered signal;

a DC/DC converter coupled to the filter to receive the filtered signal, and wherein the DC/DC converter is configured to provide power to a load;

a dimming signal generator coupled to the rectifier to receive the rectified signal, the dimming signal generator being configured to generate a dimming signal based on the rectified signal;

a feedback circuit coupled to the DC/DC converter to generate a feedback signal indicative of the power provided to the load by the DC/DC converter; and a PFC controller having a first input terminal, a second input terminal, a third input terminal, a fourth input terminal, and an output terminal, wherein:

the first input terminal is coupled to the dimming signal generator to receive the dimming signal;

the second input terminal is coupled to the rectifier to receive the rectified signal;

the third input terminal is coupled to the DC/DC converter to receive a sense signal indicative of a current flowing through the DC/DC converter;

the fourth input terminal is coupled to the feedback circuit to receive the feedback signal; and based on the dimming signal, the rectified signal, the sense signal, and the feedback signal, the PFC controller provides a switching signal at the output terminal to the DC/DC converter.

2. The switching mode power supply of claim 1, wherein the DC/DC converter comprises a flyback converter.

3. The switching mode power supply of claim 2, wherein the feedback circuit comprises an average load current calculator having a first input terminal, a second input terminal, and an output terminal, wherein the first input terminal is coupled to the logic circuit to receive the switching signal, the second input terminal is coupled to the primary winding to receive the sense signal, and wherein based on the switching signal and the sense signal, the average load current calculator provides the feedback signal.

4. The switching mode power supply of claim 3, wherein the average load current calculator comprises:

an inverter configured to receive the switching signal, and wherein based on the switching signal, the inverter generates an inverse signal of the switching signal;

a first switch having a first terminal and a second terminal, wherein the first terminal is configured to receive the sense signal;

a second capacitor coupled between the second terminal of the first switch and ground;

a second switch having a first terminal and a second terminal, wherein the first terminal of the second switch is coupled to the second terminal of the first switch, and a square-wave signal is provided at the second terminal;

a third switch, coupled between the second terminal of the second switch and the primary side ground; and an integrator having an input terminal and an output terminal, wherein the input terminal is coupled to the second terminal of the second switch to receive the square-wave signal, and wherein based on the square-wave signal, the integrator generates the feedback signal at the output terminal, and further wherein the first switch and the third switch are controlled by the switching signal;

the second switch is controlled by the inverse signal of the switching signal; and the feedback signal is provided at the output terminal of the integrator.

5. The switching mode power supply of claim 1, wherein the dimming signal generator comprises a first comparator having a first input terminal, a second input terminal, and an output terminal, and wherein the first input terminal is coupled the rectifier to receive the rectified signal, the second input terminal is coupled to a reference signal, and wherein based on the rectified signal and the reference signal, the first comparator provides the dimming signal at the output terminal.

6. The switching mode power supply of claim 1, wherein the PFC controller further comprises:

an oscillator configured to provide a set signal;

an error amplifier having a first input terminal, a second input terminal, and an output terminal, wherein the first input terminal is coupled to the dimming signal generator to receive the dimming signal, the second input terminal is coupled to the feedback circuit to receive the feedback signal, and wherein based on the dimming signal and the feedback signal, the error amplifier provides an error amplified signal;

a multiplier having a first input terminal, a second input terminal, and an output terminal, wherein the first input terminal is coupled to the rectifier to receive the rectified signal, the second input terminal is coupled to the error amplifier to receive the error amplified signal, and wherein based on the rectified signal and the error amplified signal, the multiplier provides an arithmetical signal at the output terminal;

a second comparator having a first input terminal, a second input terminal, and an output terminal, wherein the first input terminal is coupled to the multiplier to receive the arithmetical signal, the second input terminal is coupled to the DC/DC converter to receive the sense signal, and wherein based on the arithmetical signal and the sense signal, the second comparator provides a reset signal; and a logic circuit having a first input terminal, a second input terminal, and an output terminal, wherein the first input terminal is coupled to the second comparator to receive the reset signal, the second input terminal is coupled to the oscillator to receive the set signal, and wherein based on the reset signal and the set signal, the logic circuit provides the switching signal to the DC/DC converter.

7. The switching mode power supply of claim 1, wherein the PFC controller comprises:

an error amplifier having a first input terminal, a second input terminal, and an output terminal, wherein the first input terminal is coupled to the dimming signal generator to receive the dimming signal, the second input terminal is coupled to the feedback circuit to receive the feedback signal, and wherein based on the dimming signal and the feedback signal, the error amplifier provides an error amplified signal;

a multiplier having a first input terminal, a second input terminal, and an output terminal, wherein the first input terminal is coupled to the rectifier to receive the rectified signal, the second input terminal is coupled to the error amplifier to receive the error amplified signal, and wherein based on the rectified signal and the error amplified signal, the multiplier provides an arithmetical signal at the output terminal;

a second comparator having a first input terminal, a second input terminal, and an output terminal, wherein the first input terminal is coupled to the multiplier to receive the arithmetical signal, the second input terminal is coupled to the DC/DC converter to receive the sense signal, and wherein based on the arithmetical signal and the sense signal, the second comparator provides a reset signal;

a zero current detector configured to detect a current flowing through the energy storage component, wherein the zero current detector generates the set signal based on the detection; and a logic circuit having a first input terminal, a second input terminal, and an output terminal, wherein the first input terminal is coupled to the second comparator to receive the reset signal, the second input terminal is coupled to the zero current detector to receive the set signal, and wherein based on the reset signal and the set signal, the logic circuit provides the switching signal to the DC/DC converter.

8. A switching mode power supply, comprising:

a triac dimmer configured to receive an AC input voltage and modify the AC input voltage with a target phase angle to generate a shaped AC signal;

a rectifier coupled to the triac dimmer to receive the shaped AC signal, the rectifier being configured to generate a rectified signal based on the shaped AC signal;

a filter coupled to the rectifier to filter the rectified signal to generate a filtered signal;

a DC/DC converter coupled to the filter to receive the filtered signal, and wherein the DC/DC converter having a main switch operating in ON and OFF states to provide power to a load;

a dimming signal generator comprising a first comparator having a first input terminal, a second input terminal, and an output terminal, wherein the first input terminal is coupled to the rectifier to receive the rectified signal, the second input terminal is coupled to a reference signal with constant value, and wherein based on the rectified signal and the reference signal, the first comparator provides the dimming signal at the output terminal;

a feedback circuit coupled to the DC/DC converter to generate a feedback signal indicative of the power supplied to the load by the DC/DC converter; and a PFC controller having a first input terminal, a second input terminal and an output terminal, wherein the first input terminal is coupled to the dimming signal generator to receive the dimming signal, the second input terminal is coupled to the feedback circuit to receive the feedback signal, and wherein based on the dimming signal and the feedback signal, the PFC controller provides a switching signal at the output terminal to control the main switch.

9. The switching mode power supply of claim 8, wherein the DC/DC converter comprises a flyback converter.

10. The switching mode power supply of claim 8, wherein the PFC controller comprises:

an oscillator configured to provide a set signal;

an error amplifier having a first input terminal, a second input terminal, and an output terminal, wherein the first input terminal is coupled to the dimming signal generator to receive the dimming signal, the second input terminal is coupled to the feedback circuit to receive the feedback signal, and wherein based on the dimming signal and the feedback signal, the error amplifier provides an error amplified signal;

an on-time controller having a first input terminal, a second input terminal, and an output terminal, wherein the first input terminal is coupled to the oscillator to receive the set signal, the second input terminal is coupled to the error amplifier to receive the error amplified signal, and wherein based on the set signal and the error amplified signal, the on-time controller provides a reset signal at the output terminal; and a logic circuit having a first input terminal, a second input terminal, and an output terminal, wherein the first input terminal is coupled to the on-time controller to receive the reset signal, the second input terminal is coupled to the oscillator to receive the set signal, and wherein based on the reset signal and the set signal, the logic circuit provides a switching signal to control the main switch of the DC/DC converter.

11. The switching mode power supply of claim 8, wherein the PFC controller comprises:

a zero current detector configured to detect a current flowing through the energy storage component, wherein the zero current detector generates the set signal based on the detection;

an error amplifier having a first input terminal, a second input terminal, and an output terminal, wherein the first input terminal is coupled to the dimming signal generator to receive the dimming signal, the second input terminal is coupled to the feedback circuit to receive the feedback signal, and wherein based on the dimming signal and the feedback signal, the error amplifier provides an error amplified signal;

an on-time controller having a first input terminal, a second input terminal, and an output terminal, wherein the first input terminal is coupled to the zero current detector to receive the set signal, the second input terminal is coupled to the error amplifier to receive the error amplified signal, and wherein based on the set signal and the error amplified signal, the on-time controller provides a reset signal at the output terminal; and a logic circuit having a first input terminal, a second input terminal, and an output terminal, wherein the first input terminal is coupled to the on-time controller to receive the reset signal, the second input terminal is coupled to the zero current detector to receive the set signal, and wherein based on the reset signal and the set signal, the logic circuit provides a switching signal to control the main switch.

12. The switching mode power supply of claim 8, wherein the feedback circuit comprises an average load current calculator having a first input terminal, a second input terminal, and an output terminal, wherein the first input terminal is coupled to the logic circuit to receive the switching signal, the second input terminal is coupled to the main switch to receive the sense signal, and wherein based on the switching signal and the sense signal, the average load current calculator provides the feedback signal.

13. The switching mode power supply of claim 12, wherein the average load current calculator comprises:

an inverter, configured to receive the switching signal, and wherein based on the switching signal, the inverter generates an inverse signal of the switching signal;

a first switch having a first terminal, a second terminal, wherein the first terminal receives the sense signal;

a second capacitor, coupled between the second terminal of the first switch and the ground;

a second switch having a first terminal and the second terminal, wherein the first terminal of the second switch is coupled to the second terminal of the first switch, and a square-wave signal is provided at the second terminal;

a third switch, coupled between the second terminal of the second switch and the primary side ground; and an integrator having an input terminal and a output terminal, wherein the input terminal is coupled to the second terminal of the second switch to receive the square-wave signal, based on the square-wave signal, the integrator generates the feedback signal at the output terminal, and wherein the first switch and the third switch are controlled by the switching signal, the second switch is controlled by the inverse signal of the switching signal, and the feedback signal is provided at the output terminal of the integrator.

14. A method of controlling a switching mode power supply, comprising:

coupling an AC input signal to a triac dimmer, to modify the AC input signal with a target phase angle to get a shaped AC signal;

rectifying the shaped AC signal to generate a rectified signal;

filtering the rectified signal to generate a filtered signal;

coupling the filtered signal to a DC/DC converter to provide power to a load, wherein the DC/DC converter has a main switch operating in ON and OFF states;

coupling the rectified signal to a dimming signal generator to generate a dimming signal;

sensing a current flowing through the main switch to generate a sense signal;

generating a feedback signal indicative of the power supplied to the load; and generating a switching signal in response to the rectified signal, the dimming signal, the sense signal, and the feedback signal to control the main switch.

15. The method of claim 14, wherein the step of generating the switching signal in response to the rectified signal, the dimming signal, the sense signal, and the feedback signal comprises:

amplifying the difference between the dimming signal and the feedback signal to generate an error amplified signal;

multiplying the error amplified signal with the rectified signal to generate an arithmetical signal;

comparing the arithmetical signal with the sense signal to generate a reset signal;

generating an oscillation signal as a set signal; and generating the switching signal based on the reset signal and the set signal.

16. The method of claim 14, wherein the step of generating a switching signal in response to the rectified signal, the dimming signal, the sense signal, and the feedback signal comprises:

amplifying the difference between the dimming signal and the feedback signal to generate an error amplified signal;

multiplying the error amplified signal with the rectified signal to generate an arithmetical signal;

comparing the arithmetical signal with the sense signal to generate a reset signal;

detecting a current flowing through the energy storage component to generate a zero current signal as a set signal; and generating the switching signal based on the reset signal and the set signal.

17. A method of modulating current flowing through a load with a triac dimmer in a switching mode power supply, comprising:

coupling an AC input signal to a triac dimmer, to modify the AC input signal with a target phase angle to generate a shaped AC signal;

rectifying the shaped AC signal to generate a rectified signal;

filtering the rectified signal to generate a filtered signal;

coupling the filtered signal to a DC/DC converter to provide power to a load, wherein the DC/DC converter has a main switch operating in the ON and OFF states;

comparing the rectified signal with a constant reference signal to generate a dimming signal;

generating a feedback signal indicative of the power supplied to the load; and generating a switching signal in response to the dimming signal and the feedback signal to control the main switch.

18. The method of claim 17, wherein the step of generating a switching signal in response to the dimming signal and the feedback signal comprises:

generating an oscillation signal by an oscillator as a set signal;

amplifying the difference between the dimming signal and the feedback signal to generate an error amplified signal;

generating a reset signal in response to the error amplified signal and the set signal by an on-time controller; and generating a switching signal in response to the set signal and the reset signal.

19. The method of claim 17, wherein the step of generating a switching signal in response to the dimming signal and the feedback signal comprises:

detecting a current flowing through the energy storage component to generate a zero current signal as a set signal;

amplifying the difference between the dimming signal and the feedback signal to generate an error amplified signal;

generating a reset signal in response to the error amplified signal and the set signal by an on-time controller; and generating a switching signal in response to the set signal and the reset signal.

* * * * *